US005317294A

United States Patent [19]

Vielot

[11] Patent Number: 5,317,294

[45] Date of Patent: May 31, 1994

[54] ELECTROMAGNETIC RELAY

[75] Inventor: Jacques Vielot, Southfield, Mich.

[73] Assignee: Magnetic Technology, Inc., Southfield, Mich.

[21] Appl. No.: 745,595

[22] Filed: Aug. 16, 1991

[51] Int. Cl.[5] ..... H01H 51/22

[52] U.S. Cl. ..... 335/80; 335/78; 335/128

[58] Field of Search ..... 335/78–85, 335/124, 128, 131

[56] References Cited

U.S. PATENT DOCUMENTS

| | | | |
|---|---|---|---|
| 4,701,734 | 10/1987 | Nakano et al. | 335/128 |
| 4,956,623 | 9/1990 | Rolf-Dieter | 335/128 |
| 5,017,898 | 5/1991 | Kuzukawa | 335/78 |
| 5,084,688 | 1/1992 | Martino | 335/78 |

*Primary Examiner*—Lincoln Donovan

[57] ABSTRACT

A d-c electromagnetic relay, designed to open or close a circuit when a current through its exiting coils is either caused to flow or interrupted, and in some applications merely varied in magnitude. It consists of a square or rectangular coil(s) of conducting wire wound around a non-magnetic spool mounted on a "J" shaped magnetic yoke-core which in turn supports an "L" shaped armature attached to the shorter leg of the yoke at a given angle and thereby creating two non-parallel surfaces at the boundaries of the working air gap forming an open "V" at an angle that corresponds to the degree angle formed by the longer leg of the armature in relationship to the top surface of the shorter leg of the yoke, by means of a flat piece of phosphor bronze or the like designed integrally as a leaf spring spring to provide the necessary contact pressure in the open as well as in the closed position, and contact deflection and follow-through, and which is extended to accept the contact point(s). The present invention is rooted in the theory of the effect of tangent component forces in a heterogeneous magnetic field and is a special apllication.

2 Claims, 5 Drawing Sheets

ELECTROMAGNETIC RELAY

BACKGROUND OF THE INVENTION

1. Technical Field

The field of art to which this invention pertains may be generally located in the class of devices relating to electromagnet and in particular to relay or contactor.

2. Background Information

The problems encountered in the prior art magnetic relay is that the theoretical foundation guiding every area of their engineering is dated. This fact has led to the fossilization of their design and performance characteristics. The theoretical stagnation that characterizes work in this area prevented any significant improvements in the design and operations of electromagnetic relays. All the known inadequacies such as loud and unpleasant mechanical noises, the relatively small force per mass achievable on the basis of conventional theories, limited sensitivity, heating limitations, relatively high production cost due to excessive use of copper wire(s) and ferromagnetic irons in the prior art construction which relate to improper handling of the theory of the interaction between the magnetic and electric fields, fatigue caused by repeated mechanical impact, sticking, and the added problems of their assembly caused by an excessive number of component parts remained unsolved.

Previous efforts have been made in an attempt to increase the homogeneity of magnetic fields by devising new coils such as that of Gottfried J. Krueger, Reno di Leggiuno, Italy, U.S. Pat. No. 4,231,008, and L. F. Craemer et al, U.S. Pat. No. 3,523,263, and Bosch et al U.S Pat. No. 3,701,066, and Anthony Sprando U.S. Pat. No. 3,519,966, and George C. Underwood U.S Pat. No. 3,479,627.

Whatever the precise merits, features and advantages of the above cited references, none of them achieves or fulfills the purposes of the current relay.

No device is known to have the geometric configuration of the present invention or rooted in the theoretical relations that it postulates.

SUMMARY OF THE INVENTION

In fulfillment and implementation of the previously recited objects, a primary feature of the invention resides in the provision of a unique design arrangement for greater homogeneity of the magnetic field between the yoke and armature in order to achieve maximum mechanical operation. The present invention is directed to a relay or which is adapted to switch, given the application, a variety of electrical circuits. The present invention is directed at applying the new theory of the effect of tangent component force in a heterogeneous magnetic field to the design of relays, to reduce impact and noise, to prevent sticking, to increase the sensitivity, to reduce the mass and size of the electromagnet, to increase the magnetic pull power, to reduce the magnetomotive force, to reduce the power consumption, to reduce the number of component parts, to increase the efficiency of its operation and to reduce manufacturing cost. The present invention is adapted to the prior art's manufacturing materials and technics and requires no esoteric process whatsoever.

DESCRIPTION OF THE PREFERRED EMBODIMENT

Figure 1:
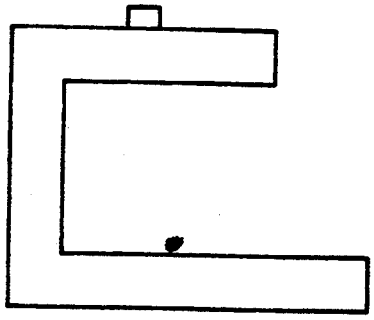
FIG. 1 and FIG. 1A represent the front and side views of the J-shaped magnetic yoke-core in accordance with the theoretical principles of the present invention.
Figure 1A:
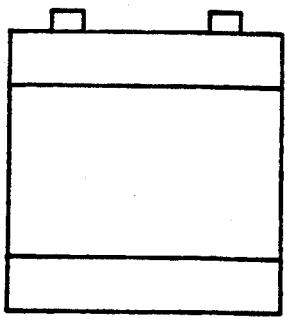
Figure 2:
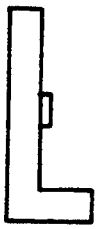
FIG. 2 and FIG. 2A are the front and side views of the L-shaped armature in accordance with the need to achieve the special relationship in the heterogeneous fields in the air gap that allows for the greater mechanical force to be developed. It is held together with the yoke-core by means of the leaf spring with the insertion of detail no. 9 and 9*a* intoı detail no. 11. of FIG. 3. Soldering the leaf spring to the yoke could be substituted for details no. 9 and no. 9*a*.
Figure 2A:
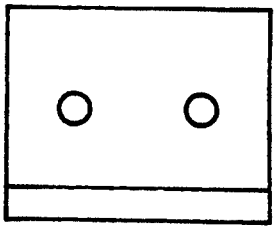
Figure 3:
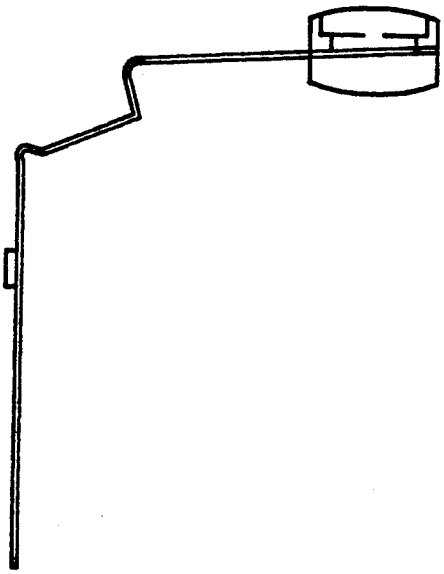
FIGS. 3 and 3A represent the side and front view of the leaf spring and contact bracket that attaches the armature to the yoke. It also provides the support, stability and rotational axis to the mechanical motion of the armature that is caused by the exited coil.
Figure 3A:
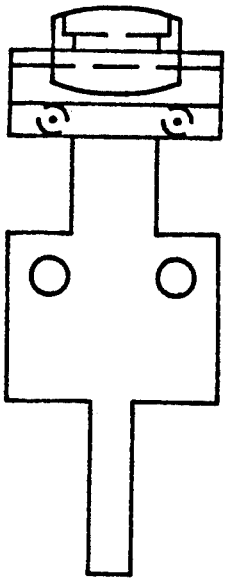
Figure 4:
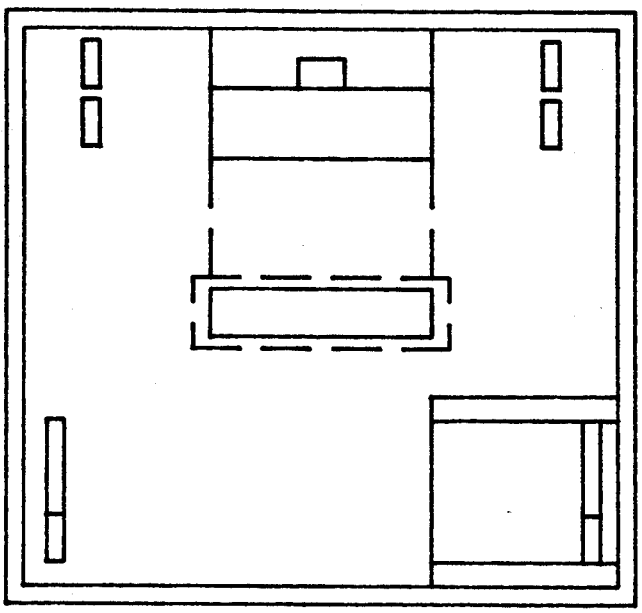
FIG. 4 and FIG. 4*a* are the front and side views of the spool integrally design to accept the coil winding(s), the yoke-core, and upper and lower contacts points assembly.
Figure 4A:
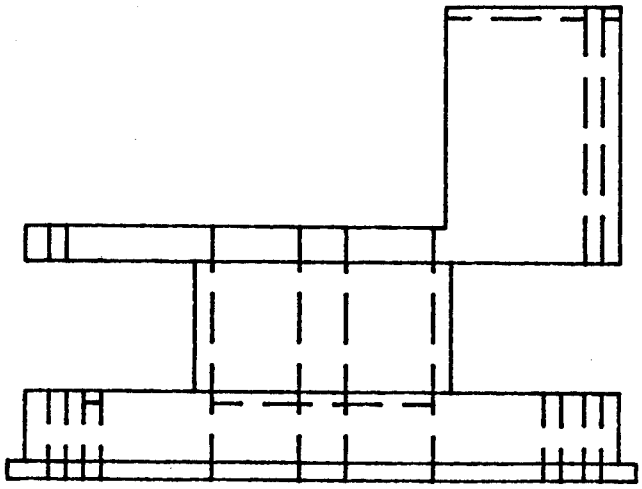
Figure 5:
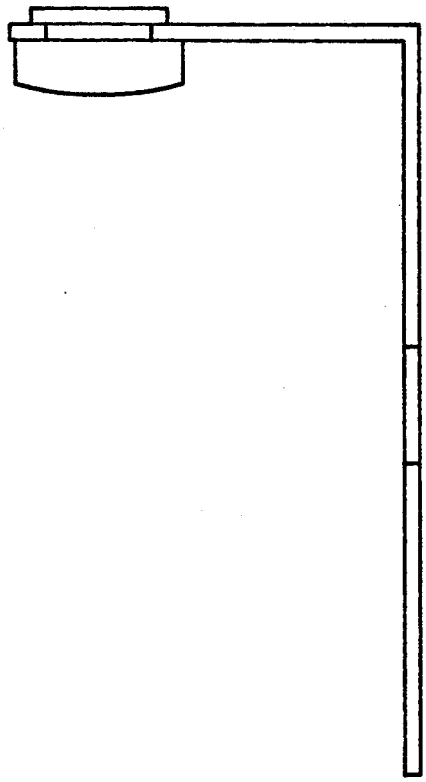
FIG. 5 and FIG. 5*a* are the front and side views of the upper contact lead that serves also as a stop to limit the upward travel of the armature and that sets the limit of the fixed gap between the contact points. It is designed to fit into detail no. 13 of the spool represented in FIG. 4*a*.
Figure 5A:
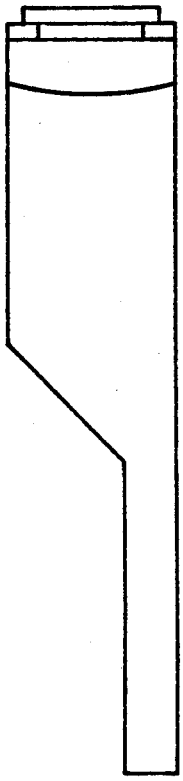
Figure 6:
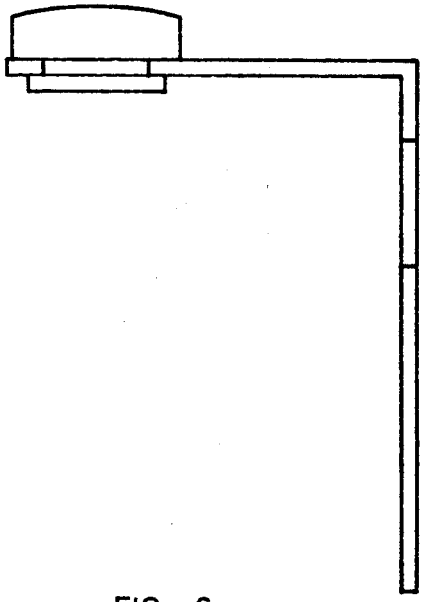
FIG. 6 and FIG. 6*a* are the front and side views of the lower contact lead situated below and simetrical with the upper contact lead and contact point. It is designed to fit into detail no. 14 of the spool represented in FIG. 4*a*.
Figure 6A:
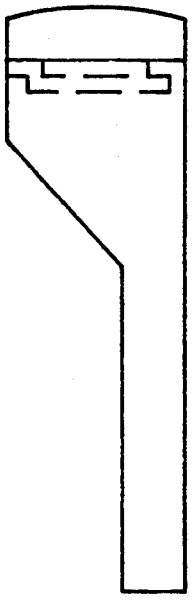
Figure 7:
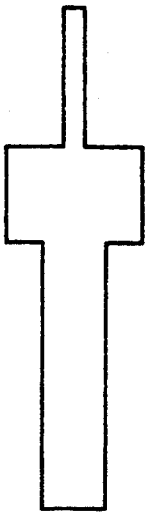
FIG. 7 and FIG. 7*a* are the front and side views of the coil lead connectors, two (2) in number, and designed to fit into details No. 15 and 16 of the spool represented in FIG. 4*a*.
Figure 7A:
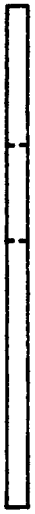
Figure 8:
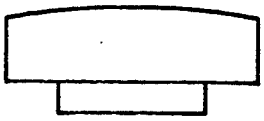
FIG. 8 and FIG. 8*a* are the front views of the contact points designed to be mated through detail no. 12 of the leaf spring shown in FIG. 3. Detail no. 10 of the section view of the assembly drawing is shadow of the coil winding. Detail no. 17 is designed to accept and to locate the tail end of the leaf spring as shown in FIG. 3.
Figure 8A:
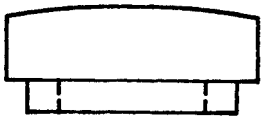
Figure 9:
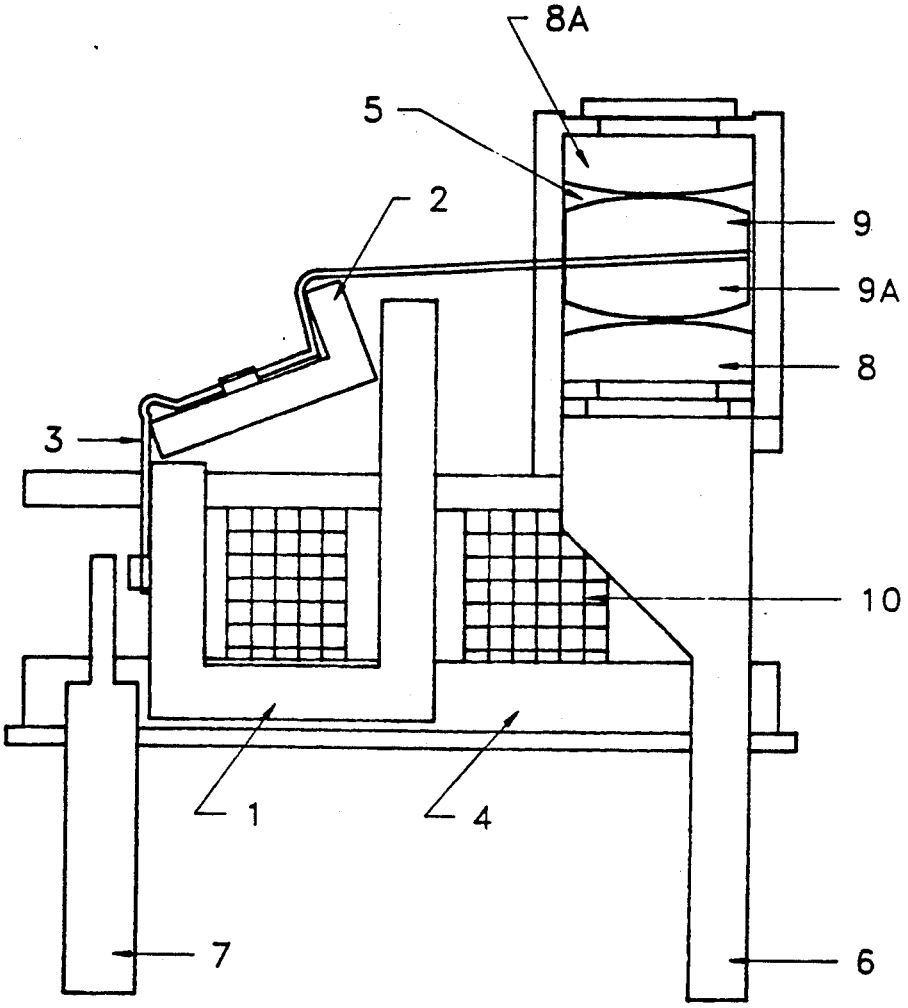
FIG. 9 shows the relay in its final assembly.

The theoretical and design foundation of the present invention is outlined in the disclosure document dated Feb. 22, 1991 No. 274692 and disclosure document dated Jul. 22, 1991 No. 287408.

The present electromagnet is adapted to operate as a relay in the normally open or normally closed position. It is composed of a yoke-core of uniform crossection and magnetic permeability. The shape of the yoke is determined by the need to integrate into a single unit the coil's core and the supporting yoke in order to guaranty the integrity of the magnetic circuit at its maximum permeance and preserve the homogeneity of the field in the magnetic iron for the maximum interaction with the tangent component forces generated in the heterogeneous field that provide for the greater and faster mechanical action of the armature. The increase in speed and strength result from the lessening of the moments of inertia created by the unevenness and combined character of the heterogeneous fields . The maximum effect of the tangent component forces in the heterogeneous field provides for the sharp reduction of the magnetomotive force while simultaneously preserving performance parameters that are far superior to those exhibited by electromagnets of the prior art. In the prior art relay, the homogeneity of the magnetic fields was considered strictly as a matter of coil configuration. In other instances, complex anti-friction design of the armature and of its supporting element were attempted in order to achieve rapid motion. The actual geometry of the yoke and of the armature as they pertain to rendering F(h) and F(K) as homogeneous as possible throughout the volume the air gaps was never taken into account.

On this yoke-core's longer leg is fitted the current carrying coil assembly which is rectangular in shape and whose dimensions are determined by the required magnetomotive force and the need to reduce infinitessimally, if not to eliminate completely, an additional fixed air gap between the current carrying coil and the magnetic coil core. The coil's magnetic yoke-core is thus mated with the inner surface of the spool and the slot centrally located and opposite to the core at the outer edge. The spool is non-magnetic and non-conducting and is made preferably of plastic material, or the like. It is designed to assure the integrity of the electrical connections and to adapt either to perforated circuit boards or hard wired to the circuit. This method of assembly eliminates the need for added screws and rivets and guaranties the alignment of the contact(s) point(s) in relationship to the position of the armature and the need to assure that the point(s) make contact reliably. The contact point(s) could be made of either tungsten, silver or platinum given the type of load (resistance or inductance), type of break (slow or quick), type of use (number of contacts per minute).

The typically L-shaped armature is fabricated with the same magnetic iron material as the yoke-core and with the same crossectional area. It is fastened to the yoke in such a way that the end opposite the ninety degree angle formed by the bottom leg is placed on top of and in contact with the shorter leg of the yoke simetrically and constitute the pivotal point. It is fixed to the yoke, located and stabilized by means the springing unit at an angle to create between the exterior surface of the bottom leg and the opposite interior surface of the yoke's longer leg, which is the effective core of the current carrying coil, a non-parallel working air gap. The bottom leg of the armature, when energized will come into close contact with the interior surface of the coil's core which is the yoke's longer leg without impact or noise. The design under consideration is conducive to rapid motion, increased mechanical strength, reliability, and manufacturing advantage. Also, it improves the life cycle of the unit and avoid fatigue due to non-impact, increase resistance to deleterious effect of such use.

What is claimed is:

1. An electromagnetic relay comprising:
an electromagnetic coil wound about a bobbin;
a stamped J-shaped magnetic pole piece integrally forming the core and yoke portions;
said core portion having a first section entirely within the bobbin and a second section extending beyond the top of the bobbin;
said second section extending substantially a quarter of the length of the said first section or as determined by the mechanical requirement derived from the tangential force;
said yoke portion, extending parallel to the core portion being substantially the same length as said first core section;
an L-shaped armature carrying a contact spring;
said L-shaped armature having first and second legs;
said first leg pivotally mounted about the end of the yoke;
said second leg being in close proximity and parallel to the said second core portion.

2. An electromagnetic relay comprising:
a coil wound about a bobbin;
a unitary core piece having first and second sections;
said first section being entirely within the central axis of the bobbin;
said second section extending above the top of the bobbin substantially one quarter the length of said first section;
a yoke extending to the top of the bobbin;
an armature piece pivotally mounted on an end of the yoke having first and second legs;
said first leg pivotally mounted on the end of the yoke;
said second leg extending away from said top of said bobbin in close proximity and in parallel to the yoke side of the second core piece;
said second armature leg being attracted to said second core section by the effect of tangent component forces generated when the coil is excited.

* * * * *